US005601282A

United States Patent [19]

Milo et al.

[11] Patent Number: 5,601,282

[45] Date of Patent: Feb. 11, 1997

[54] SHINGLE FEEDER

[76] Inventors: Alfred Milo, 11400 Fourth St. North, St. Petersburg, Fla. 33716; Todd Werner, 1400 49th Ave. NE., St. Petersburg, Fla. 33703

[21] Appl. No.: 529,915

[22] Filed: Sep. 18, 1995

[51] Int. Cl.[6] ..... B65H 3/04

[52] U.S. Cl. ..... 271/35; 271/110; 271/121; 271/124

[58] Field of Search ..... 271/35, 121, 124, 271/125, 110, 114

[56] References Cited

U.S. PATENT DOCUMENTS

| | | | |
|---|---|---|---|
| 2,819,077 | 1/1958 | Goss | 271/35 |
| 4,114,870 | 9/1978 | Blasio | 271/35 |
| 4,565,361 | 1/1986 | Tanaka et al. | 271/110 |
| 4,772,004 | 9/1988 | Golicz | 271/124 |
| 5,244,198 | 9/1993 | Greek | 271/121 |

FOREIGN PATENT DOCUMENTS

| | | | |
|---|---|---|---|
| 0218444 | 9/1988 | Japan | 271/121 |

*Primary Examiner*—H. Grant Skaggs
*Attorney, Agent, or Firm*—James B. Middleton

[57] ABSTRACT

A feeder for sheets of material has belts for driving sheets through the feeder, and a gate above the belts to hold back the stack of sheets to be fed. The gate is elliptical in side elevational view and flat in front and rear elevational views. The major axis of the ellipse is disposed at an acute angle to the feed path, so sheets waiting to be fed engage the large-radius portion of the ellipse and are shingled just before reaching the position to be fed. The wide, flat surface has O-rings of rubber or the like to provide a high coefficient of friction for retarding the stack of sheets to be fed. A sensor detects a sheet that has been fed, and stops the feeder, so the feeder can be used as an on-demand feeder.

6 Claims, 3 Drawing Sheets

SHINGLE FEEDER

BACKGROUND OF THE INVENTION

1. Field of the Invention

This invention relates generally to sheet feeders and the like, and is more particularly concerned with a shingle feeder wherein shingling of the sheets is begun prior to actual feeding.

2. Discussion of the Prior Art

There are numerous feeders that are intended to feed one sheet at a time from a stack of sheets. Many such feeders are designed for use on printing presses and the like that receive one sheet, process that one sheet, then receive another sheet for processing. The feeder for such a machine therefore can carefully handle each sheet to be fed, and there is time to utilize such techniques as an air blast to separate sheets. Other equipment requires a substantially continuous feed of sheets, for example for collating multiple pieces for mass mailings, or for delivering pieces to a bindery or other equipment that requires a stream of pieces rather than one sheet or piece at a time.

The prior art shingle feeders have been reasonably successful; but, very simple feeders are temperamental and difficult to set up properly, while more reliable feeders are complex and require a good bit of maintenance. Thus, the prior art has not provided an extremely simple shingle feeder that is both easy to use and reliable.

SUMMARY OF THE INVENTION

The present invention provides a shingle feeder having an elliptical gate member. Pieces to be fed are supported on belts that move in a forward direction to cause the feeding of the pieces, while the gate member prevents the feeding of all but the lowermost piece. The piece being fed is at the small-radius portion of the gate member, while pieces being held abut the large-radius portion of the gate member. The major axis of the ellipse preferably forms an acute angle with the feed path, so the pieces being held engage the large-radius portion and are somewhat shingled before they reach the position to be fed.

In the preferred embodiment of the invention the belts are driven through a clutch and brake arrangement, and a photoelectric cell detects the leading edge of the piece being fed. When the piece is detected, the brake is activated to terminate the feed. The piece will then be removed by the gripper of a conventional inserter; and, the photoelectric cell will detect the absence of a piece and will actuate the clutch to feed another piece. The feeder of the present invention can therefore be used as a demand feeder if desired. By disabling the photoelectric cell, the feeder will feed continuously.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
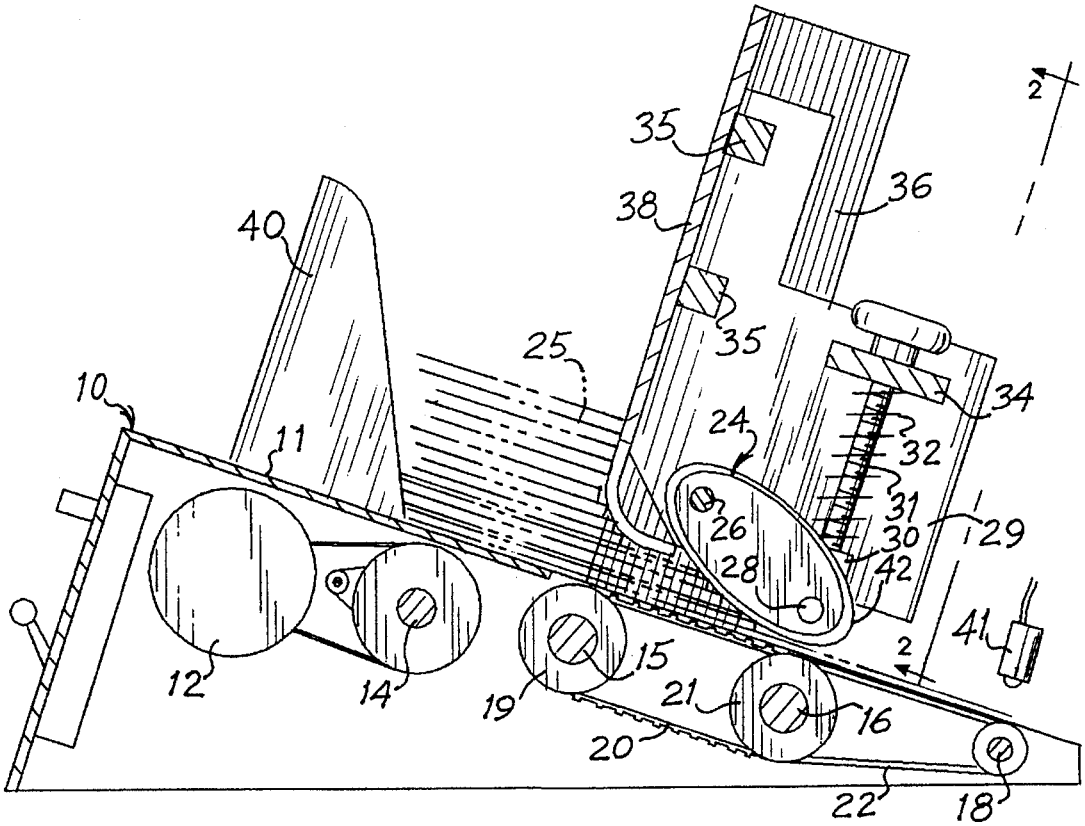
FIG. 1 is a longitudinal cross-sectional view of a feeder made in accordance with the present invention.

Referring now more particularly to the drawings, and to that embodiment of the invention here presented by way of illustration, FIG. 1 shows a feeder having a housing 10 with an upper platform 11. As here shown, the platform 11 is sloped downwardly towards the front, or discharge, end. The embodiment of the invention here shown is for use on an inserter, and the configuration of the housing 10 fits well onto a conventional inserter. Those skilled in the art will understand that the device can be differently oriented for other applications.

On the rear panel of the housing 10 are the electric controls, which may include switches and the like for controlling the actions of the feeder. These controls may be mounted anywhere one wishes, but the rear panel is convenient and accessible.

Within the housing 10 is a drive motor, and various shafts for driving the feed belts of the feeder. The motor is designated at 12, and it drives a shaft 14. The shaft 14, in turn, drives the shafts 15, 16 and 18. None of the drive connections is shown in FIG. 1, but these will be described in detail hereinafter.

As seen in FIG. 1, the shaft 15 carries rollers 19 and belts 20. The belts 20 are trained over appropriate pulleys on the shaft 16, and the shaft 16 also includes rollers 21. Finally, there are belts 22 that extend between the shaft 16 and the shaft 18. The upper courses of the belts 20 are disposed below the gate member 24 and provide the feeding force for feeding a sheet from the stack 25, while the belts 22 receive the piece and hold it for removal by a gripper or the like. As is indicated above, the feeder of the present invention is here presented as used as a feeder for an inserter, and a conventional inserter includes a gripper to grip and remove a piece and place it in a particular pocket.

Looking specifically at the gate member 24, the gate is elliptical in side elevational view and is mounted on two pivots 26 and 28. The pivot 26 comprises a rod held by the opposed mounting plates 29, while the pivot 28 is adjustably supported by a block 30. The block 30 is carried at the lower end of an adjusting screw 31 having a spring 32 therearound. Thus, the spring 32 acts between the block 30 and an upper plate 34. The result is that the block 30 is normally urged down, but can be raised by operation of the screw 31 so the forward end of the gate member 24 can be adjusted with respect to the belts 20 and the rollers 21.

The mounting plates 29 are fixed to cross bars 35, the cross bars 35 being supported on side extensions 36 of the housing 10. Also fixed to the cross bars 35 is a plate 38 for holding the forward edge of the stack 25. Plates such as the plate 38 are well known in the art, and the lower end curves forwardly at 39 to allow pieces to move forward and engage the gate member 24. A rear guide 40 urges the lower end of the stack towards the gate member.

At the forward end of the feeder there is a photoelectric cell at 41. The photocell 41 will be placed at the point where the piece being fed should stop to be picked up by the gripper of the inserter.

Figure 2:
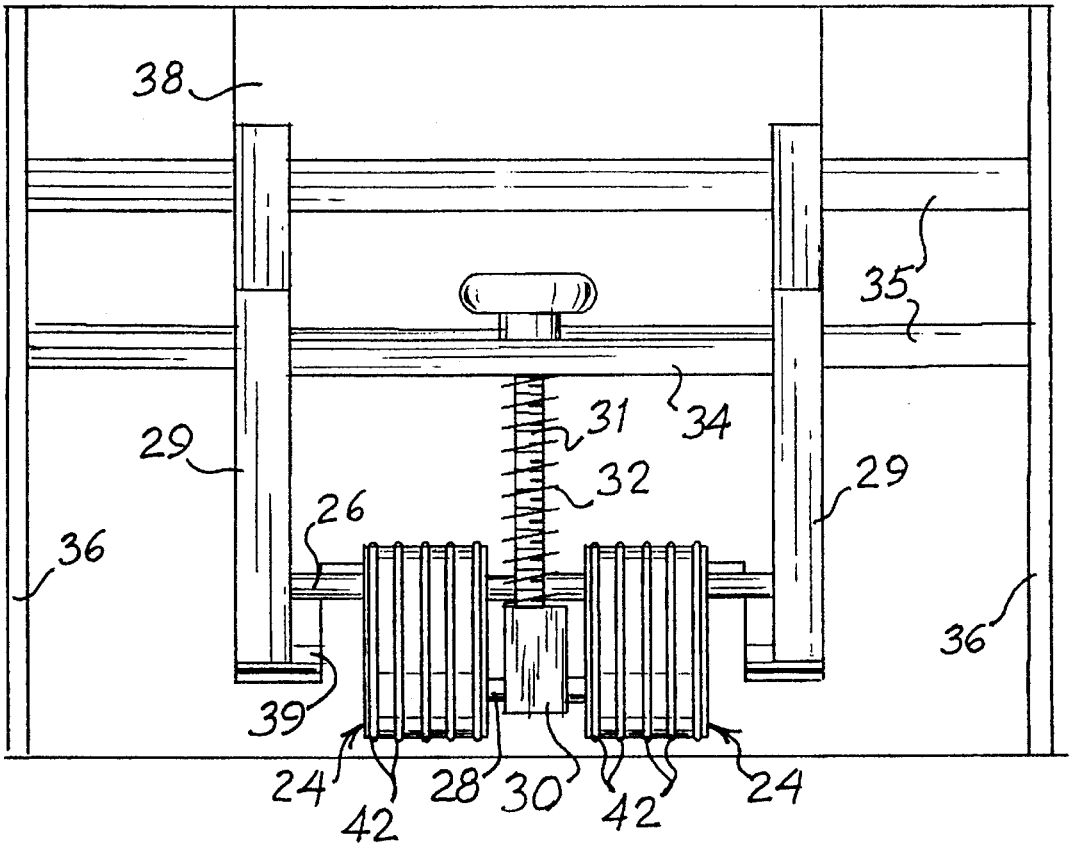
FIG. 2 is a front elevational view as taken along the line 2—2 in FIG. 1.

For a better understanding of the construction of the gate members 24 and their mounting, attention is directed to FIGS. 1 and 2. In FIG. 2 it can be seen that the gate members 24 are relatively wide and flat in front and rear elevational views for engaging the pieces to be held. The flat surfaces of the gates need to have a high coefficient of friction to assist in retarding the pieces to be held. While the gate members themselves may be made of, or covered with, rubber or the like, as here shown the gate members 24 have grooves defined in their flat surfaces, and O-rings 42 of rubber or other such material are received within the grooves.

Figure 3:
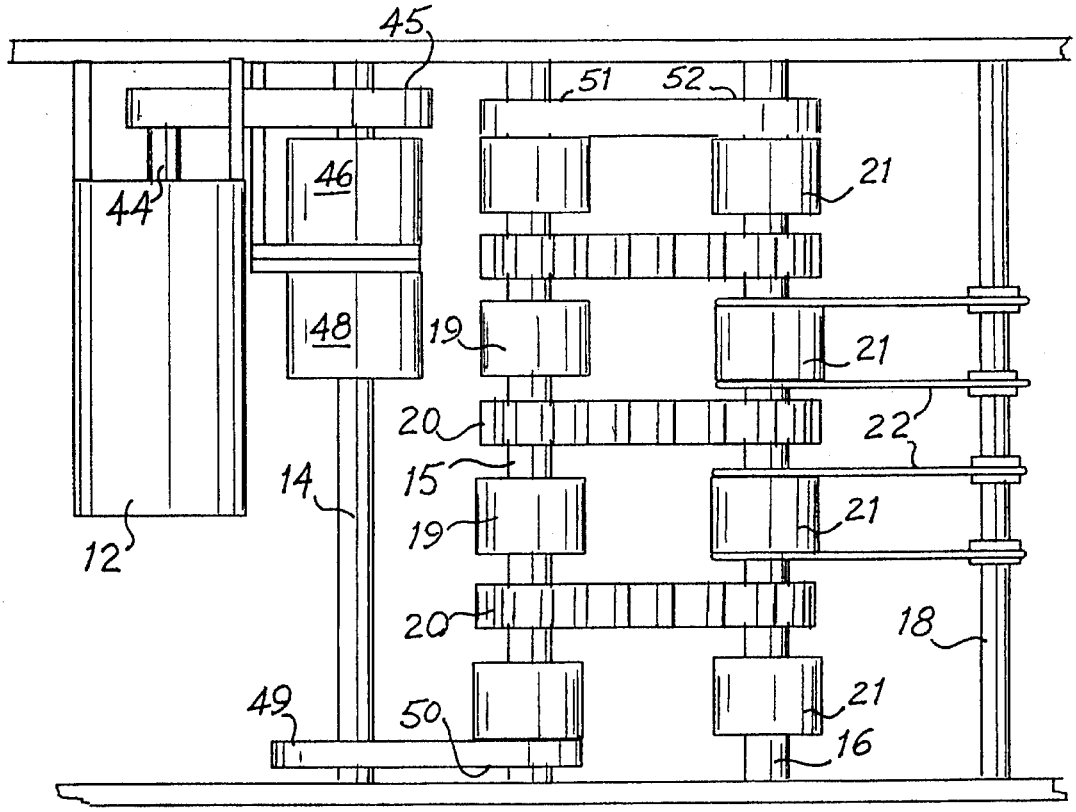
FIG. 3 is a top plan view showing the drive mechanism and feed belts of the device shown in FIG. 1; and, FIG. 4 is a schematic diagram showing electrical controls for the device of FIG. 1.

The drive arrangement for the device of the present invention is shown in FIG. 3 of the drawings. It will be seen that the motor 12 is mounted from the housing 10 and has an output drive 44 that drives a pulley 45 on the shaft 14. Also on the shaft 14 is a clutch 46 and a brake 48. When the clutch 46 is engaged, the pulley 45 will drive the shaft 14. When the clutch 46 is disengaged and the brake 48 is activated, the shaft 14 will be held from rotation.

At the opposite end of the shaft 14, a pulley 49 drives a pulley 50 on the shaft 15; and, on the opposite end of the shaft 15 there is a pulley 51 that drives a pulley 52 on the shaft 16. Finally, two of the rollers 21 on the shaft 16 include pulleys for receiving the belts 22.

In FIG. 3 it can be seen that the rollers 19 and 21 are substantially the same diameter as the belts 20, so all the rollers 19 and 21, and the belts 20, can support the weight of the stack 25 being fed. Furthermore, the belts 20 have lugs thereon to increase the frictional hold on the piece being fed. Other expedients may be used to increase the hold on the pieces, but the belts with lugs are simple and readily available.

Figure 4:
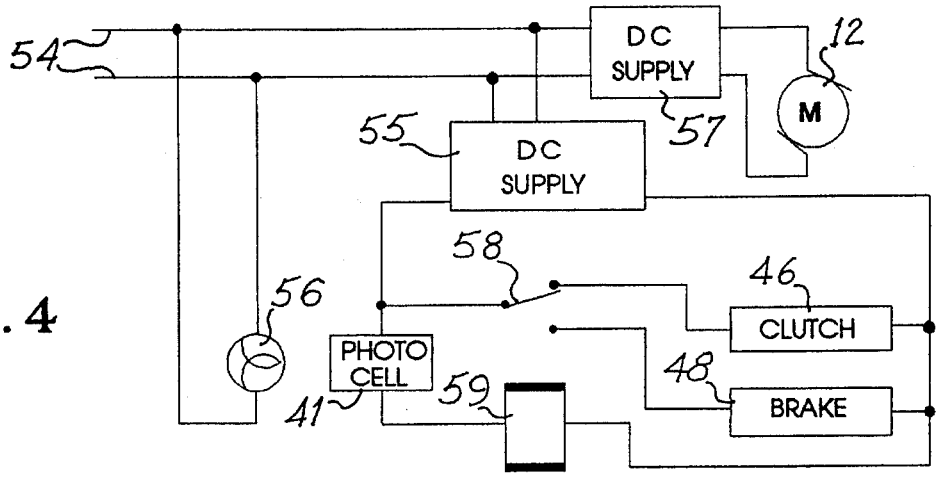

FIG. 4 shows an electric control circuit for the feeder disclosed herein. Conventional 120 V.A.C. will be supplied on the lines 54, and these lines are connected, through a D.C. power supply 57, to the motor 12; and, the lines 54 are connected to the D.C. power supply 55 for the control circuitry.

A light 56 is connected to the power lines 54, and provides light for the photoelectric cell 41. Those skilled in the art will understand that the light source 56 may be on one side of a piece being fed, with the photocell 41 on the other so the piece will block the light source. Alternatively, single units are available wherein the light source and photocell are in the same physical unit, and the photocell acts off reflected light. Either system may be used in the present invention.

To control the clutch and brake 46 and 48, it will be seen that one side of each is connected to the D.C. power supply 55, and the other side is connected to a single-pole-double-throw relay contact 58. The common point of contact 58 is connected to the power supply 55, so the position of the contact determines which is energized, the clutch or the brake.

The clutch 46 is connected to the normal point of the contact 58, and the brake 48 is connected to the transfer point. Thus, when the photocell 41 reads light, the relay 59 will be energized to transfer the contact 58 and energize the brake 48 and de-energize the clutch 46. When the light is blocked, the relay 59 will be de-energized, the contact 58 will return to normal, and the clutch 46 will be energized.

From the above and foregoing description, it will be seen that the feeder of the present invention provides a very simple yet effective feeder. The feeder can be used to feed substantially continuously by disabling the photocell 41 and allowing the device to run continuously, or it can be used as shown to be a demand feeder.

The gate member 24 is easily adjusted for a large or small gap to fit the thickness of the pieces being fed; and, in any case, there is an adequate surface to hold the stack, allowing only one piece to be fed at one time. Meanwhile, the lower end of the stack is shingled by engagement with the sloping, elliptical surface, rendering the final feeding very efficient.

It will of course by understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A feeder, for feeding pieces from a stack of pieces, said pieces being fed one at a time from the bottom of said stack of pieces, said feeder comprising a plurality of belts for receiving said stack of pieces thereon, gate means for detaining some pieces of said stack of pieces while allowing the lowermost piece of said stack of pieces to pass said gate means, and means for driving said plurality of belts for feeding said lowermost piece, said gate means comprising a gate member elliptical in side elevational view and flat in front and rear elevational views, and having its major axis disposed at an acute angle to said plurality of belts so that said stack of pieces enters the acute angle, a fixed pivot for mounting the upper, rearward end of said gate member and a movable pivot for mounting the lower, forward end of said gate member, means for raising and lowering said movable pivot for varying the space between said gate member and said plurality of belts, and means for giving the flat surface of said gate member a high coefficient of friction.

2. A feeder as claimed in claim 1, and further including spring means for urging said movable pivot down towards said plurality of belts.

3. A feeder as claimed in claim 1, said means for driving said plurality of belts comprising a drive shaft for driving said belts, a motor, a clutch for selectively connecting said motor to said drive shaft, and a brake on said drive shaft for selectively stopping said drive shaft, sensing means for determining when one of said pieces has been fed by said feeder, and circuit means responsive to said sensing means for deactivating said clutch and activating said brake.

4. A gate member for a sheet feeder, said sheet feeder including a feed path for sheets being fed, said gate member comprising a member elliptical in side elevational view and having a major axis and a minor axis, and having small-radius portions at opposite ends of said major axis, means for supporting said gate member adjacent to said feed path with said major axis at an acute angle with respect to said feed path with one of said small-radius portions substantially at said feed path, so that sheets being fed abut said gate member between said small-radius portions, and including means for varying the distance from said one of said small-radius portions to said feed path.

5. A gate member as claimed in claim 4, said gate member being flat in front and rear elevational views, and further including means for giving the flat surface a high coefficient of friction.

6. A gate member as claimed in claim 5, said flat surface defining a plurality of grooves therein, and a plurality of O-rings received within said grooves for providing said high coefficient of friction.

* * * * *